US011404826B1

(12) United States Patent
Demaratos

(10) Patent No.: US 11,404,826 B1
(45) Date of Patent: Aug. 2, 2022

(54) HIGH VOLTAGE CONNECTOR ASSEMBLY HAVING IMPROVED FEMALE AND MALE HOUSINGS WITH A FEMALE TERMINAL POSITION ASSURANCE (TPA) DEVICE, AND AN IMPROVED METHOD FOR IMPROVING CLEARANCE AND CREEPAGE IN THE HIGH VOLTAGE CONNECTOR ASSEMBLY

(71) Applicant: J.S.T. CORPORATION, Farmington Hills, MI (US)

(72) Inventor: David Demaratos, Wixom, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/399,578

(22) Filed: Aug. 11, 2021

(51) Int. Cl.
*H01R 4/50* (2006.01)
*H01R 13/639* (2006.01)
(Continued)

(52) U.S. Cl.
CPC ..... *H01R 13/639* (2013.01); *H01R 13/518* (2013.01); *H01R 13/6272* (2013.01); *H01R 13/631* (2013.01)

(58) Field of Classification Search
CPC .. H01R 13/518; H01R 13/629; H01R 13/631; H01R 13/639; H01R 13/6272
(Continued)

(56) References Cited

U.S. PATENT DOCUMENTS 8,840,435 B2 * 9/2014 Plazio ..... H01R 13/502 439/607.41
9,039,450 B2 * 5/2015 Germ ..... H01R 13/65912 439/607.41
2012/0196467 A1 8/2012 Liptak

FOREIGN PATENT DOCUMENTS

WO 2013/079358 A1 6/2013
WO 2020/176910 A1 9/2020

OTHER PUBLICATIONS

International Search Report for International Application No. PCT/US2021/045781 dated Nov. 18, 2021 (3 sheets).

* cited by examiner

*Primary Examiner* — Khiem M Nguyen
(74) *Attorney, Agent, or Firm* — Kratz, Quintos & Hanson, LLP

(57) ABSTRACT

A high voltage connector assembly having improved female and male housings with a female terminal position assurance (TPA) device, and a method for improving clearance and creepage of the electrical path in the high voltage connector assembly. The female housing includes an intermediate upper portion having apertures for respectively receiving front downward extending members of frontward extending members of the female TPA device to finally lock high voltage electrical terminals in the female housing, and to place the female TPA device in a full-lock position inside the female housing. When fully assembled, the clearance and creepage of the electrical path in the high voltage connector assembly extends in a substantially vertical direction from the high voltage electrical terminals, and extends along a separator wall of the male housing and towards a rear portion of the female housing in a substantially horizontal direction across an intermediate upper portion of the female housing and into adjacent high voltage electrical terminals. Also, when in a full-lock position, the TPA device, in its entirety, resides outside of the female housing with the exception of the downward extending members in such a manner as to not require any part of the TPA device to enter the cavities that house the terminals while being assembled or while resting in a pre-lock position to allow the terminals to be substantially fully encapsulated in all directions by a continuous insulating material.

16 Claims, 11 Drawing Sheets

(51) Int. Cl.
*H01R 13/627* (2006.01)
*H01R 13/518* (2006.01)
*H01R 13/631* (2006.01)

(58) Field of Classification Search
USPC ..... 439/345, 352, 752
See application file for complete search history.

HIGH VOLTAGE CONNECTOR ASSEMBLY HAVING IMPROVED FEMALE AND MALE HOUSINGS WITH A FEMALE TERMINAL POSITION ASSURANCE (TPA) DEVICE, AND AN IMPROVED METHOD FOR IMPROVING CLEARANCE AND CREEPAGE IN THE HIGH VOLTAGE CONNECTOR ASSEMBLY

BACKGROUND OF THE INVENTION

Due to the high voltage that a high voltage connector assembly is required to meet and due to the design of traditional shielded automotive connectors, it is desired that clearance and creepage from at least a high voltage electrical terminal to another high voltage electrical terminal, to an electrical element/circuit, be improved or increased.

SUMMARY OF THE INVENTION

This invention is directed to a connector assembly having improved female and male housings with a female terminal position assurance (TPA) device, and an improved method for improving clearance and creepage in the high voltage connector assembly of this invention. The high voltage connector assembly of this invention is highly suitable for high voltage electrical terminals, which are larger terminals. The female TPA device of this invention includes the improved female housing with a front portion and a rear portion, the front portion thereof having an upper portion with an opening for allowing therein only front downward extending members of frontward extending members of the female TPA device. The improved male housing includes an inside separating wall, which when in operation, is placed between frontward extending members of the front portion of the TPA device. With the above-described structural arrangements of this invention, "creepage" (a measurement of the shortest path along the surface from any given circuit in a connector to any (usually adjacent) other circuit), and "clearance" (defined as, e.g., a measurement of the shortest electrical path from any exposed electrically conducting element in a given circuit of a connector to any other electrically conducting element in a different circuit in the same connector) are advantageously increased.

DETAILED DESCRIPTION OF THE PREFERRED EMBODIMENTS

Figure 1:
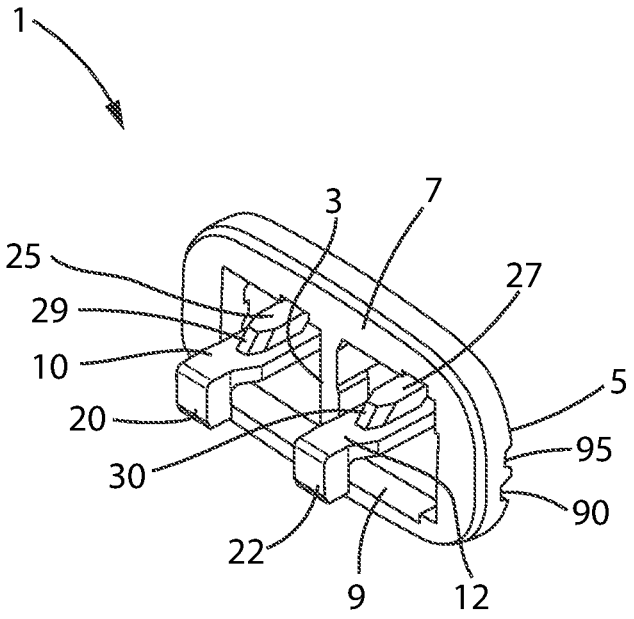
FIG. 1 is a front perspective view of a female terminal position assurance (TPA) device for use in an improved female high voltage connector assembly of this invention.

FIG. 1 illustrates a front perspective view of the female terminal position (TPA) device, generally referred to as reference numeral 1. The female TPA device 1 includes a middle member 3 and a rounded member 5. The middle member 3 extends from an upper portion 7 to a lower portion 9 of the rounded member 5. The rounded member 5 has, on opposite sides thereof, frontward extending members 10, 12 extending therefrom.

Figure 2:
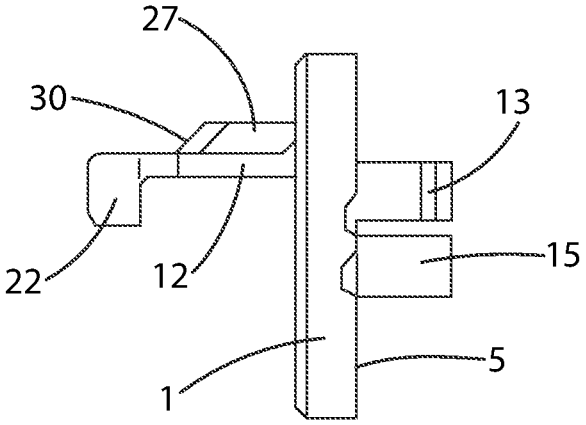
FIG. 2 is a side elevational view of the female TPA device for use in the improved female high voltage connector assembly of this invention.

Illustrated in FIG. 2 are an upper backward extending member 13 and a lower backward extending member 15. At a front end of each of the frontward extending members 10, 12 is a corresponding front downward extending member 20, 22. Also each of the frontward extending members 10, 12 has corresponding upper members 25, 27; and each of the upper members 25, 27 has a corresponding ramp-like front end 29, 30.

Figure 3:
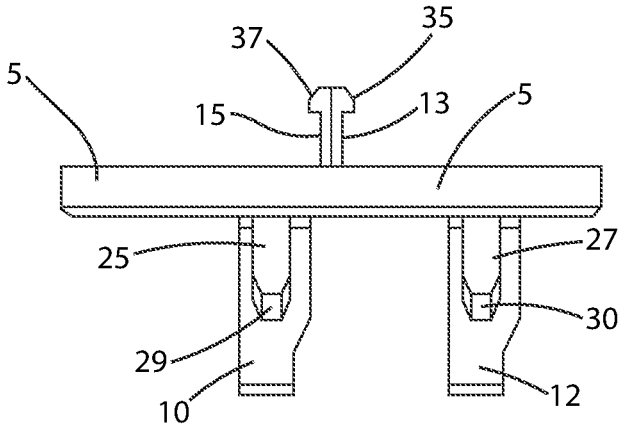
FIG. 3 is a top elevational view of the female TPA device for use in the improved female high voltage connector assembly of this invention.
Figure 4:
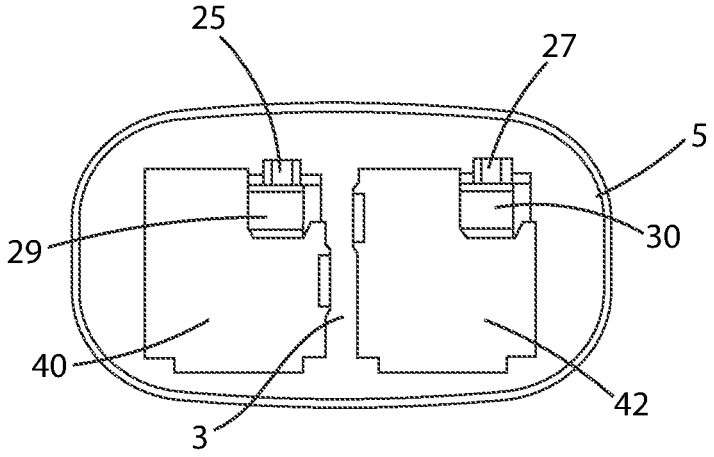
FIG. 4 is a front elevational view of the female TPA device for use in the improved female high voltage connector assembly of this invention.

Shown in FIG. 3 is a top elevational view of the female TPA device 1, which illustrates the frontward extending members 10, 12, the corresponding upper members 25, 27 respectively extending therefrom, and the ramp-like front ends 29, 30, respectively, thereof. Also shown are the upper backward extending member 13 and the lower backward extending member 15. The upper backward extending member 13 has an upper barb-like member 35 extending therefrom, while the lower backward extending member 15 has a lower barb-like member 37 extending therefrom. Passing through both sides of the female TPA device 1 are openings 40, 42 with the middle member 3 therebetween, as shown in FIG. 4.

Figure 5:
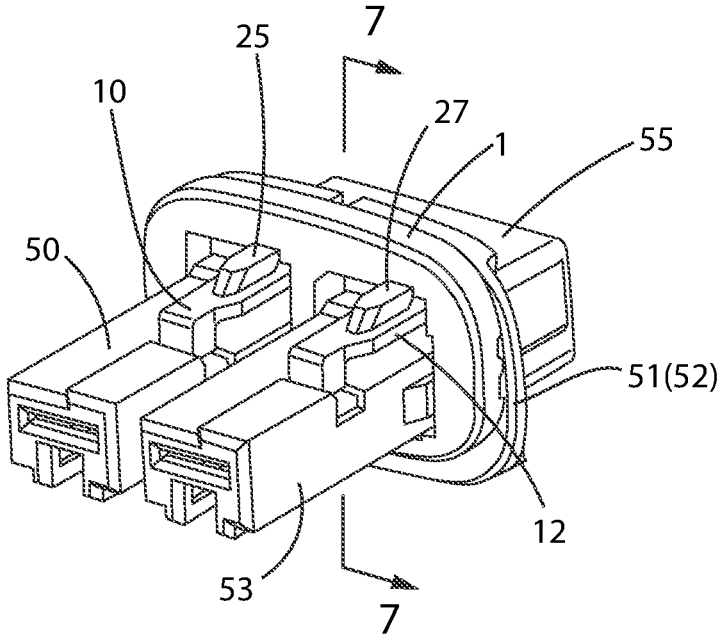
FIG. 5 is a perspective view of the improved female housing of this invention having fitted or installed therein the female TPA device, at a pre-lock position.
Figure 6:
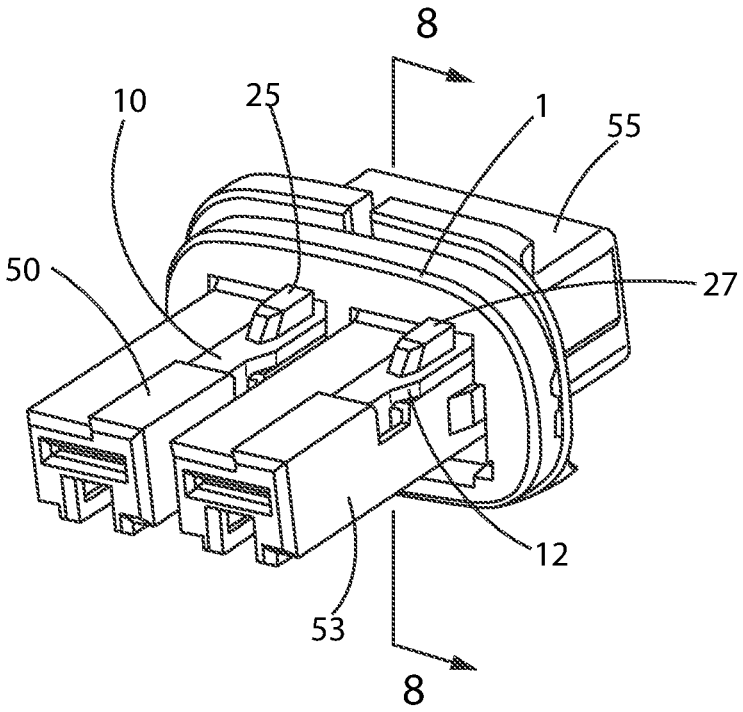
FIG. 6 is a perspective view of the improved female housing of this invention having fitted or installed therein the female TPA device, at a full-lock position.

FIG. 5 illustrates the female TPA device 1 in a pre-lock position while inserted into and mounted onto an improved female housing 50. The improved female housing 50 has a front portion 53 and a rear portion 55. FIG. 6 illustrates the female TPA device 1 in a full-lock position while inserted into and mounted onto the improved female housing 50.

As discussed in more detail below, this invention includes the improved female housing 50, which shows in FIG. 7, the TPA device 1 in pre-lock position where the improved female housing 50 will allow only the front downward extending members 20, 22 of the frontward extending members 10, 12, respectively, of the TPA device 1 to enter the improved female housing 50. As also shown in FIG. 7 (a cross-section taken along line 7-7 in FIG. 5), the thickness of a front upper portion 61 of the improved female housing 50 is thicker than an intermediate upper portion 59 of the improved female housing 50.

Figure 8:
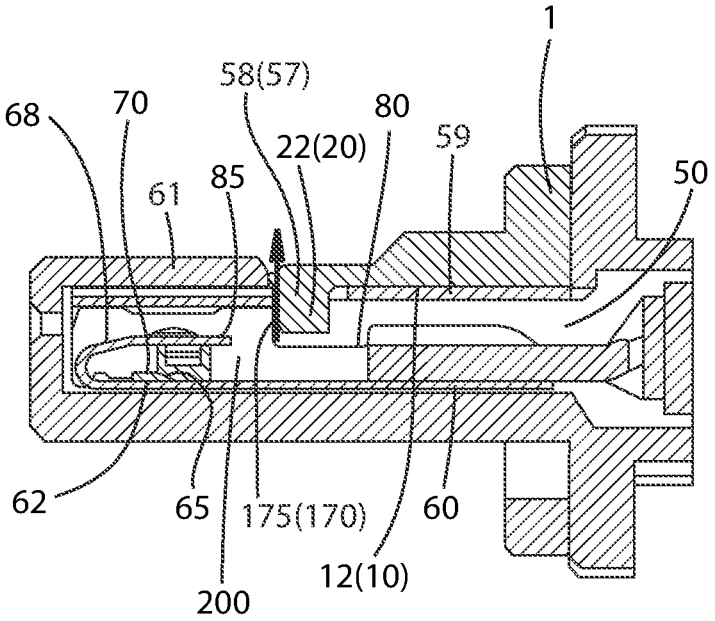
FIG. 8 is a cross-sectional view taken along cross-sectional line 8-8 in FIG. 6 showing the corresponding high voltage terminal with the corresponding front downward extending member of the corresponding frontward extending member of the female TPA device in a full-lock position inside the improved female housing of this invention, and further illustrating the clearance or creepage for the electrical path extending from the high voltage electrical terminal, as shown in a vertical arrow.

As illustrated in FIG. 8 (a cross-section taken along line 8-8 in FIG. 6), the TPA device 1 is in full-lock position where the improved female housing 50 allows only the front downward extending members 20, 22 of the frontward extending members 10, 12, respectively, of the TPA device 1 to enter the apertures 57, 58, respectively, of the intermediate upper portion 59 of the improved female housing 50. With the above-described structural arrangement, this invention is also highly suitable for high voltage electrical terminals 60, which are larger terminals.

Figure 7:
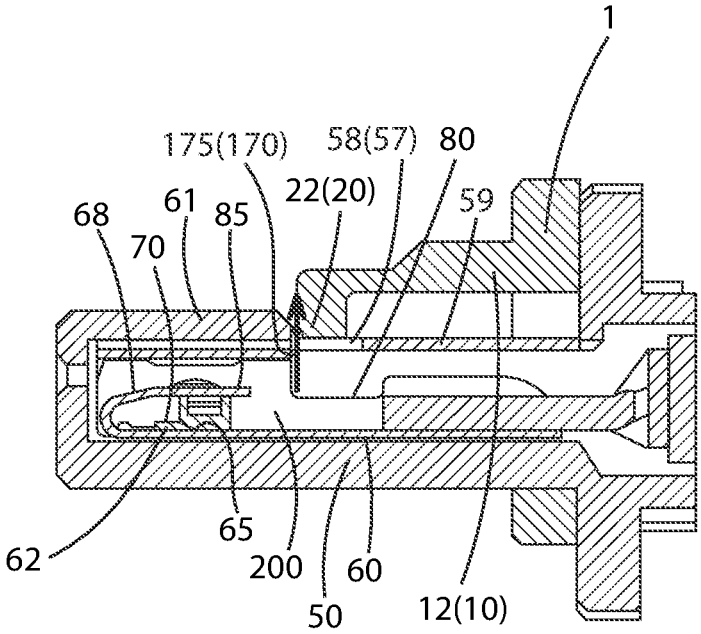
FIG. 7 is a cross-sectional view taken along cross-sectional line 7-7 in FIG. 5 showing a corresponding high voltage terminal with a corresponding front downward extending member of a corresponding front downward extending member of the corresponding frontward extending member of the female TPA device in a pre-lock position inside the improved female housing of this invention, and further illustrating the clearance or creepage for the electrical path extending from the high voltage electrical terminal, as shown in a vertical arrow.

Further illustrated in each of FIGS. 7 and 8, respectively extending substantially vertical through the apertures 57, 58 of the intermediate upper portion 59 of the improved female housing 50 is a clearance or creepage for an electrical path 170, 175 (see arrow) from respective exposed high voltage electrical terminal 60. With the above-described characteristics of this invention, as described above and shown in FIGS. 7 and 8, the "creepage" (a measurement of the shortest electrical path along the surface from any given circuit to any (usually adjacent) other circuit, here another high voltage electrical terminal 60), and the "clearance" (a measurement of the shortest electrical path from any exposed electrically conducting element, here a high voltage electrical terminal 60, in a given circuit of a connector to any other electrically conducting element in a different circuit in the same connector, here another high voltage electrical terminal 60) are advantageously increased, as will further be explained in more detail below.

As also shown in FIG. 7, a protruding member 62 extends from a lower portion of the improved female housing 50. The protruding member 62 includes a ramp-like leading end 65. A leading portion 68 of the terminal 60, in turn, has a notch 70 such that when the terminal 60 is fully inserted into the improved female housing 50, the notch 70 readily passes over the ramp-like leading end 65 of the protruding member 62. Upon the terminal 60 being fully inserted into the improved female housing 50, the protruding member 62 of the improved female housing 50 snaps into the notch 70 of the leading end portion 68 of the terminal 60, thereby locking (primary lock) the terminal 60 inside the improved female housing 50.

Further in FIG. 7, the female TPA device 1 is at a pre-lock position. As discussed above, the terminal 60 is locked (primary lock) when the protruding member 62 inside the improved female housing 50 snaps into or enters the notch 70 of the leading end portion 68 of the terminal 60. Consequently, the terminal 60 cannot be pulled out from the improved female housing 50; and such time, an upper notch 80 of the terminal 60 becomes available for respectively receiving or accommodating therein a corresponding one of the front downward extending members 20, 22, which enter and pass through the apertures 57, 58, respectively, on the top of the intermediate upper portion 59 of the improved female housing 50. That is, unless the terminal 60 is in the primary lock position inside the improved female housing 50 and the upper notch 80 of the terminal 60 is available to receive or accommodate therein a corresponding one of the front downward extending members 20, 22, the front downward extending members 20, 22 are unable to enter through the apertures 57, 58 and to provide the necessary secondary lock to the terminal 60 inside the improved female housing 50. In other words, if the terminal 60 is not in the primary lock inside the improved female housing 50, the female TPA device 1 is prevented, by an upper portion 85 of the leading portion 68 of the terminal 60, from being further pushed downward. Consequently, if the upper portion 85 of the leading portion 68 of the terminal 60 blocks the female TPA device 1 (more particularly, blocks the front downward extending members 20, 22 of the female TPA device 1), the female TPA device 1 is able to detect that the terminals 60 are not in their proper locations or not in correctly installed positions or locations; i.e., the female TPA device 1 is unable to be further pushed downward, and therefore unable to provide the secondary lock for the terminal 60 inside the improved female housing 50 (i.e., the female TPA device 1 cannot be further pushed downward to the full-lock position).

FIG. 8 illustrates the improved female TPA device 1 being in the full-lock position inside the improved female housing 50. The shape of the front downward extending members 20, 22 is substantially similar to the edge or perimeter of the apertures 57, 58 and are sized respectively to fit within the apertures 57, 58, this aids in the alignment and acceptance of the front downward extending members 20, 22 within the apertures 57, 58. Here, the upper notch 80 of the primary locked terminal 60 becomes available for accommodating therein the corresponding one of the front downward extending members 20, 22 of the frontward extending members 10, 12, respectively, of the improved female TPA device 1; and therefore, when inserted inside a respective one of the upper notches 80 of the terminals 60, the front downward extending members 20, 22 of the frontward extending members 10, 12, respectively, of the improved female TPA device 1 respectively block the primary locked terminals 60 from being pulled away from the protruding member 62 and removed from the improved female housing 50, and thus the TPA device 1 is able to provide the secondary lock for the terminals 60 inside the improved female housing 50.

As further shown in each of FIG. 7 (pre-lock position of the female TPA device 1) and FIG. 8 (full-lock position of the female TPA device 1), as the female TPA device 1 is oriented on or into the improved female housing 50, the creepage or clearance for the vertical portions 170, 175 of the electrical path (see, arrow) are shown, substantially extending vertically, from the high voltage electrical terminals 60 through the apertures 57, 58 passing through the apertures 57, 58 of the upper intermediate portion 59 of the improved female housing 50. It is also noted herein that the front downward extending members 20, 22 are substantially directly behind a portion of the corresponding high voltage electrical terminals 60, respectively, to provide the secondary locks for the high voltage electrical terminals 60 inside the improved female housing 50.

As further illustrated in FIGS. 7 and 8, the female TPA device 1 is activated (or moved relative to the female housing 50) in a direction perpendicular to the direction along which the high voltage terminals 60 are inserted into the female housing 50.

Figure 9:
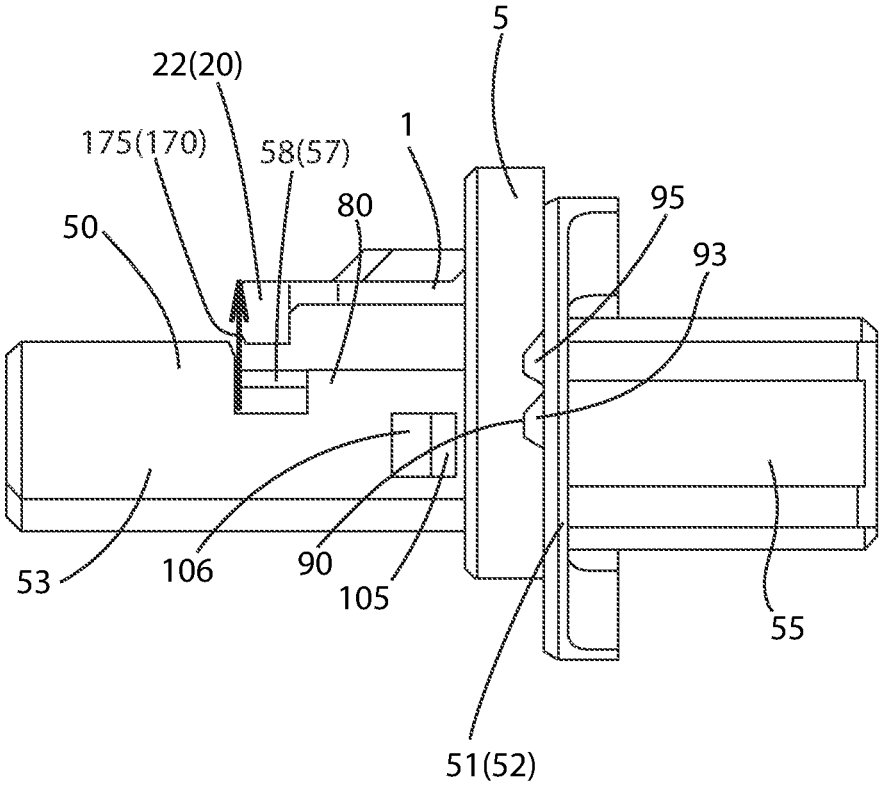
FIG. 9 illustrates the clearance or creepage for the electrical path extending from the high voltage electrical terminal, as shown in a vertical arrow passing through corresponding apertures of an upper intermediate portion of the improved female housing, wherein the front downward extending members of the corresponding frontward extending members partially or about to enter the corresponding apertures of the upper intermediate portion of the improved female housing of this invention, at a pre-lock position.

Also, the female TPA device 1 of this invention has such a geometrical shape or structural arrangement (as previously described) whereby the female TPA device 1 resides, in its entirety, outside of the female housing 50, with the exception of only the downward extending members 20, 22, in such a manner as to not require any part of the female TPA device 1 to pass through or enter into the cavities 200 containing the high voltage electrical terminals 60 while the female TPA device 1 is being assembled with the female housing 50 or while resting in a pre-lock state or position (see, FIGS. 5, 7, and 9). As described earlier, only the downward extending members 20, 22 enter the terminal cavities 200 through the apertures 57, 58, never pass through the apertures 67, 68, and do so only when the female TPA device 1 is in the full-lock state or position. The above-described structural arrangement allows each high voltage electrical terminal 60 to be fully encapsulated in all directions by four walls (i.e., the top, bottom, and both sides of continuous insulating material (i.e., the female housing 50 made of, for example, resin) with the exception of a small discontinuity required for the apertures 57, 58 needed for the downward extending members 20, 22 to pass through when the TPA device 1 is in a full-lock position or state.

Furthermore, the female TPA device 1 is locked or unlocked from the front of the connector assembly (i.e., the mating end of the connector assembly). This allows the TPA device 1 to be used on fully shielded connector assemblies, which would otherwise prevent the use of any TPA device that is actuated at the back of the connector assembly (i.e., the end wire of the connector assembly) due to shielding required at the back of the connector and features from the shield needed to contact (electrically ground to) the shielding on the wire.

Figure 10:
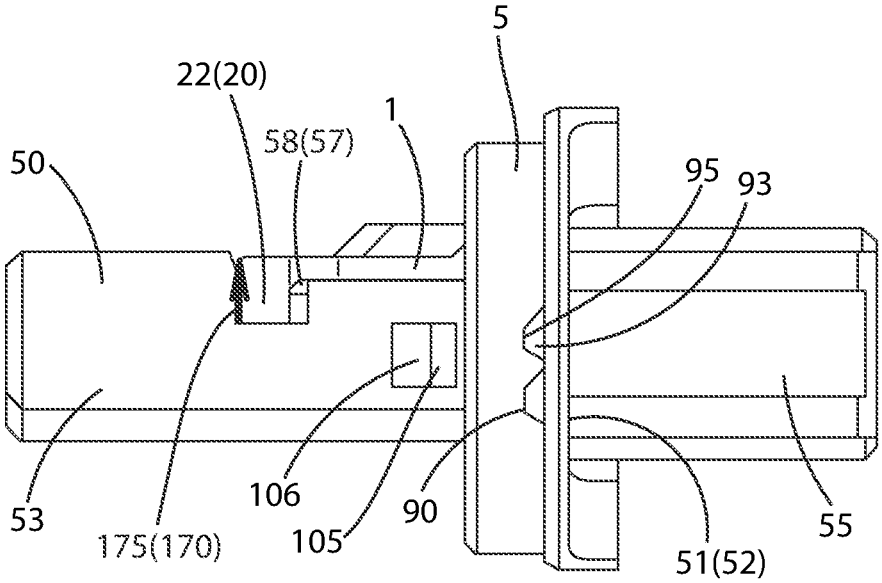
FIG. 10 illustrates the clearance or creepage for the electrical path extending from the high voltage electrical terminal, as shown in a vertical arrow passing through a corresponding aperture of an upper intermediate portion of the improved female housing, wherein the front downward extending members of the corresponding frontward extending members fully enter the corresponding apertures of the upper intermediate portion of the improved female housing of this invention, at a full-lock position.

As illustrated in FIG. 9, the female TPA device 1 is in the pre-lock position in the improved female housing 50, while, as illustrated in FIG. 10, the female TPA device is in the full-lock portion in the improved female housing 50. Shown in FIG. 9 are the downward extending members 20, 22 of the frontward extending members 10, 12 of the female TPA device 1, above or partially inserted into the apertures 57, 58 passing through the intermediate upper portion 59 of the improved female housing 50. In FIGS. 9 and 10, the creepage or clearance for the vertical portions 170, 175 of the electrical path (see, arrow) are shown, substantially extending vertically, from the high voltage electrical terminals 60 and through the apertures 57, 58 of the upper intermediate portion 59 of the improved female housing 50.

Figure 11A:
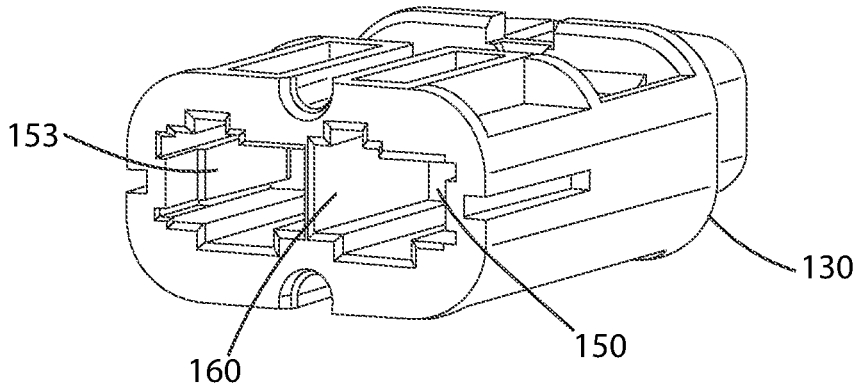
FIG. 11A illustrates an improved male housing of this invention for accepting therein the female housing and the TPA device, and further illustrates a separation wall inside the male housing for separating the upper members of the frontward extending members located in the front portion of the TPA device when the improved male housing houses therein the TPA device and the improved female housing.
Figure 11B:
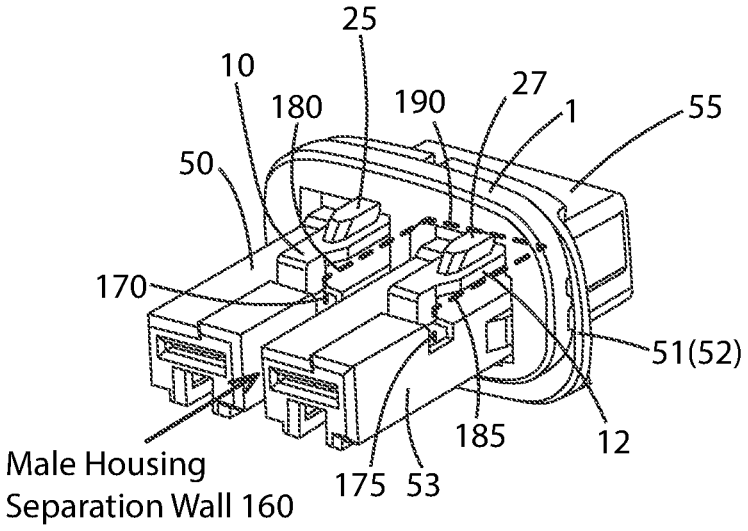
FIG. 11B illustrates the TPA device and the improved female housing of this invention assembled together, further illustrates an arrow to show the direction into which the separating wall inside in the male housing travels to be placed between the frontward extending members of the front portion of the TPA device, and further illustrates the increased clearance between adjacent electrical terminals housed within the improved female housing of this invention.

FIG. 11A illustrates an improved male housing 130 having openings 150, 153 for accepting therein the front portion 53 of the female housing 50. As further illustrated in FIG. 11A, the openings 150, 153 are separated by a separation wall 160 of a male housing 130. The separation wall 160, which as further discussed below, separates the adjacent high voltage electrical terminals 60 housed within the female housing 50. When the female housing 50 and the male housing 130 are to assembled together, the divided front portion 53 of the female housing 50 is partitioned or separated by the separation wall 160, which is placed as shown in the in FIG. 11B. With the separation wall 160 being located, as shown in FIG. 11B, the front downward extending members 20, 22 of the frontward extending members 10, 12, which house therein the high voltage electrical terminals 60, are similarly partitioned or separated by the separation wall 160. As further shown in FIG. 11B, is the vertical portions 170, 175 of the electrical path extending from the high voltage electrical terminals 60 out of the apertures 57, 58 and the electrical path having creepage along the upper intermediate portion 59 (as shown in dashed lines at 180, 185) then extending towards the rear portion 55 of the female housing 50, traversing along and around the separation wall 160. With the separation wall 160 extending up to near the front of the rounded member 5 of the female TPA device 1, the substantially horizontal portions 180, 185 of the creepage for the electrical path further transverses and extends around the separation wall 160 and traverses (as shown in dashed lines in 190) substantially in front and along a portion of the rounded member 5 of the female TPA device 1. With the vertical portions 170, 175, and horizontal portions 180, 185, 190 of the creepage for the electrical path, extending as shown in FIGS. 11B and 12, the clearance of the electrical path between the terminals 60 in this invention is increased, and therefore significantly improved.

Figure 12:
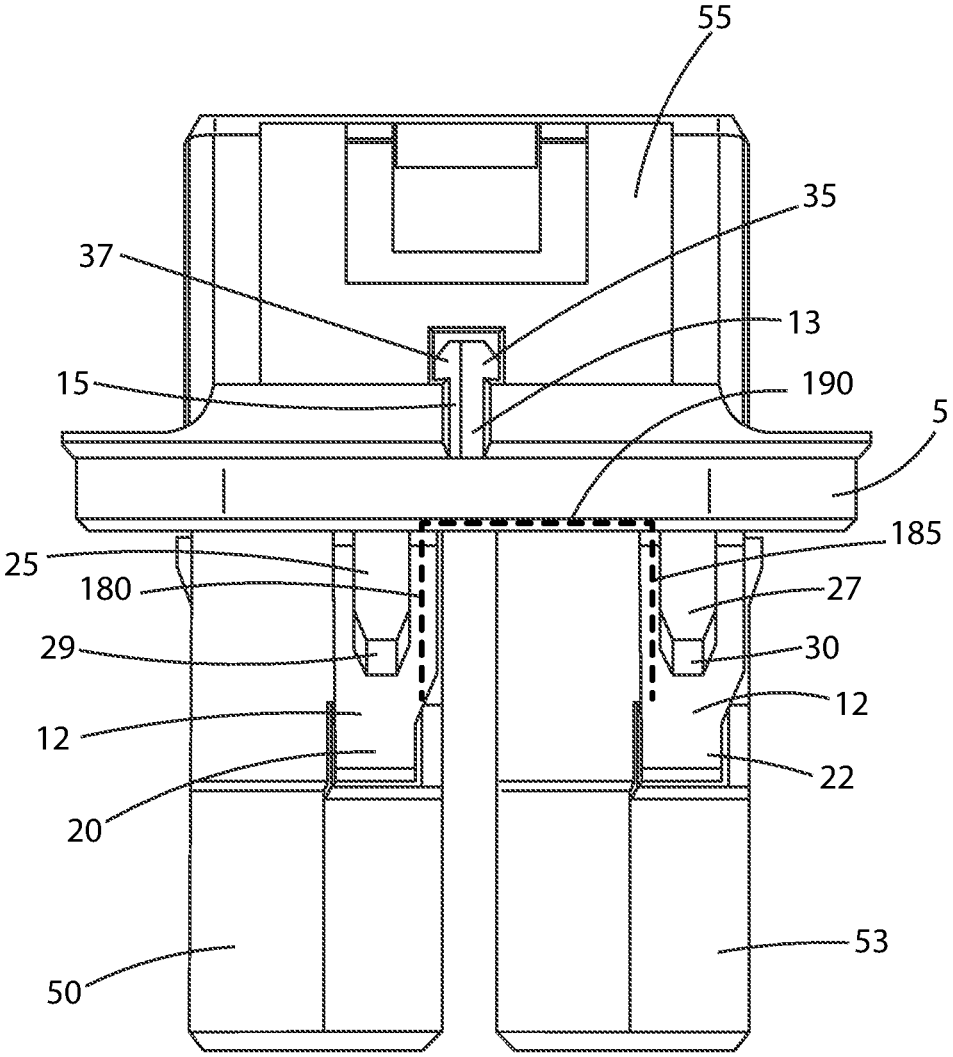
FIG. 12 is a top elevational view of the TPA device and the improved female housing of this invention assembled together, and further illustrates the substantially horizontal portions of the increased clearance for the electrical path, shown in dashed lines, between adjacent electrical terminals housed within the improved female housing of this invention.

FIG. 12 is a top elevational view of the female TPA device 1 and the female housing 50 assembled together, and further illustrates the creepage of the electrical path substantially horizontal portions 180, 185, 190 shown as dashed lines, and showing the clearance around the separation wall 160, and between adjacent electrical terminals 60 housed within the female housing 50. The clearance is increased because the electrical path is required to traverse backwards along the top of the upper immediate portion 59 and separation wall 160, both of which introduces more surface area (i.e., more distance is provided or introduced for creepage, which is the shortest electrical path along a surface) or for clearance, which flows directly through air that is not through an insulating barrier) between the apertures 57, 58 and exposed portion of the terminals 60 which further directs the creepage path in a route that increases the clearance between the terminals 60.

Figure 13A:
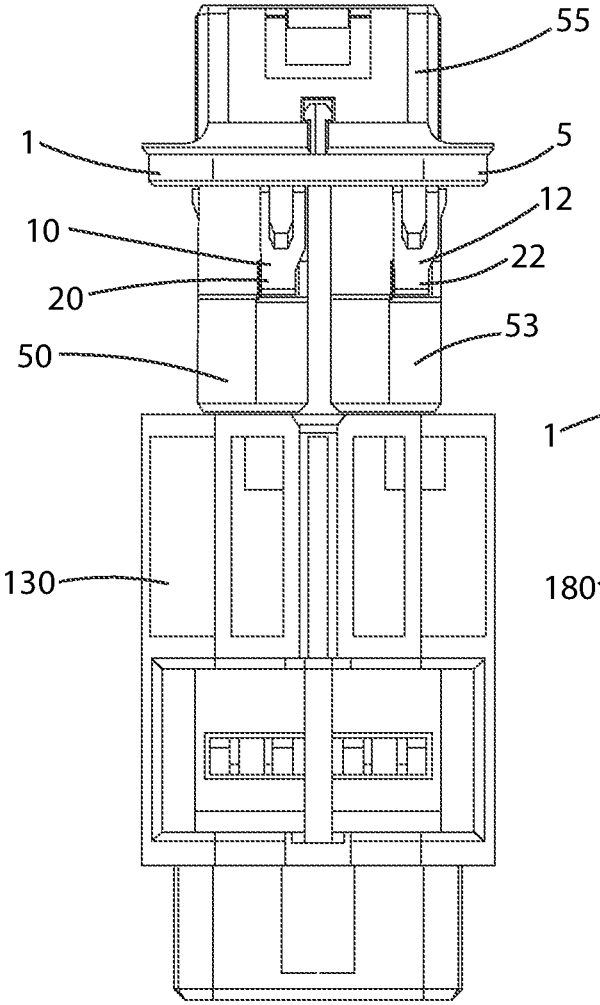
FIG. 13A is a top elevational view of the TPA device and the improved female housing of this invention, fully assembled, to be inserted into the improved male housing of this invention.
Figure 13B:
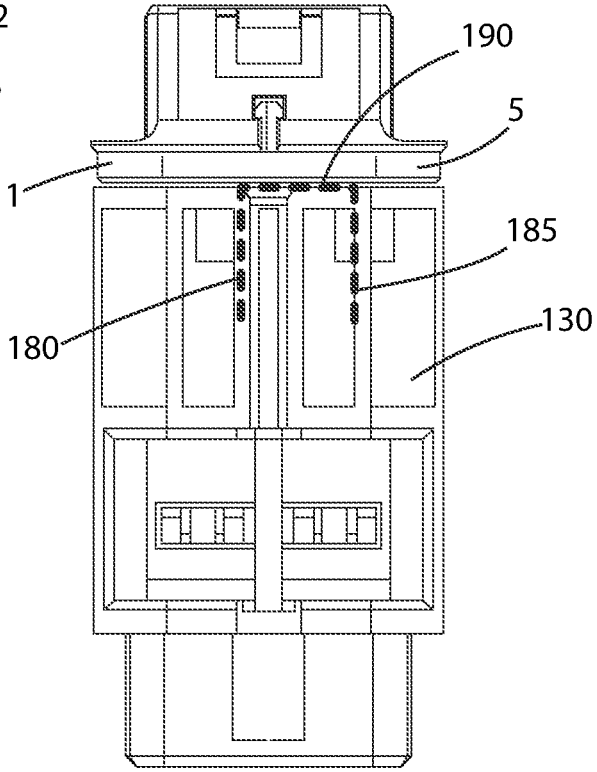
FIG. 13B is a top elevational view of the improved male housing of this invention having housed therein the fully assembled TPA device and improved female housing of this invention, and further illustrates the substantially horizontal portions of the increased clearance for the electrical path, shown in dashed lines, between adjacent terminals housed within the improved female housing of this invention.

FIG. 13A is a top elevational view of the TPA device 1 and the female housing 50, fully assembled, to be inserted into the male housing 130. The male housing 130 having therein the separation wall 160 (see, FIG. 11A). FIG. 13B is a top elevational view of the male housing 130 housing therein the fully locked TPA device 1 and the female housing 50, and further illustrates the creepage of the substantially horizontal portions 180, 185, 190 and illustrates the resulting clearance for the increased electrical path, represented by the same dashed lines, between the adjacent terminals 60 housed within the female housing 50.

As discussed above with respect to FIGS. 11A and 11B, the creepage of the electrical path includes the substantially horizontal portions 180, 185, 190, further illustrated in FIGS. 12, 13A, 13B, which are allowed to traverse a portion of the sides of the separating wall 160 placed between the divided front portion 53 of the female housing 50, which respectively house therein adjacent high voltage electrical terminals 60. As mentioned previously, the separating wall 160 increases the route of the electrical path within the high voltage connector assembly from one adjacent high voltage electrical terminals 60 to the other, increasing the creepage of the electrical path; and with this increase, the clearance between the exposed portion of the electrical terminals 60 within the high voltage connector assembly of this invention is significantly improved for high voltage applications and use.

The present invention is not limited to the above-described embodiments; and various modifications in design, structural arrangement or the like may be used without departing from the scope or equivalents of the present invention.

I claim:

1. A high voltage connector assembly, comprising:

a female terminal position assurance (TPA) device having front and back portions, wherein said front portion includes frontward extending members with front downward extending members;

a female housing having a front upper portion, an intermediate upper portion, and a back portion, said female housing substantially encapsulating therein at least a high voltage electrical terminal, wherein said intermediate upper portion includes apertures passing therethrough for accommodating therein said front downward extending members of said female TPA device; and a male housing having a separator wall for separating a front portion of said female housing having openings for respectively accepting therein said frontward extending members of said TPA device, wherein only said front downward extending members of said TPA device are accommodated within cavities inside said female housing containing said high voltage electrical terminal when said TPA device is in a full-lock position.

2. The high voltage connector assembly according to claim 1, wherein said separator wall of said male housing further respectively separates high voltage electrical terminals accommodated within said female housing.

3. The high voltage connector assembly according to claim 2, wherein said female housing preliminarily locks said high voltage electrical terminals within said female housing.

4. The high voltage connector assembly according to claim 3, wherein said front downward extending members of said female TPA device finally locks said high voltage electrical terminals within said female housing.

5. The high voltage connector assembly according to claim 3, wherein said female TPA device is in a pre-lock position.

6. The high voltage connector assembly according to claim 4, wherein said female TPA device is in a full-lock position.

7. The high voltage connector assembly according to claim 1, wherein said high voltage electrical terminal is fully encapsulated in substantially all directions by said female housing when said TPA device is in full-lock position.

8. The high voltage connector assembly according to claim 7, wherein said female housing is made of resin.

9. A method for assembling a high voltage connector assembly, comprising the steps of:

respectively inserting high voltage electrical terminals inside a female housing;

respectively locking said high voltage electrical terminals inside said female housing;

respectively inserting front downward extending members of frontward extending members of a female TPA device into apertures passing through an intermediate upper portion of said female housing; and separating adjacent high voltage electrical terminals, locked within said female housing, with a separation wall of a male housing that houses said female housing therein, wherein only said front downward extending members of said TPA device are accommodated within cavities inside said female housing containing said high voltage electrical terminals when said TPA device is in a full-lock position.

10. The method for assembling said high voltage connector assembly according to claim 9, wherein said step of respectively inserting said front downward extending members of said frontward extending members of said female TPA device finally locks said high voltage electrical terminals within said female housing.

11. The method for assembling said high voltage connector assembly, according to claim 9, wherein said step of respectively inserting said front downward extending members of said frontward extending members of said female TPA device places said female TPA device in a final-lock position within said female housing.

12. The method for assembling said high voltage connector assembly according to claim 9, wherein said high voltage electrical terminal is fully encapsulated in substantially all directions by said female housing when said TPA device is in full-lock position.

13. The method for assembling said high voltage connector assembly according to claim 12, wherein said female housing is made of resin.

14. A method for improving clearance and creepage in a high voltage connector assembly using a female terminal position assurance (TPA) device in female and male housings of said high voltage connector assembly, comprising the steps of:

respectively inserting high voltage electrical terminals inside said female housing;

respectively inserting front downward extending members of frontward extending members of said female TPA device into apertures formed by an intermediate upper portion of said female housing;

separating adjacent high voltage electrical terminals, with a separator wall of an improved male housing that houses said female housing therein; and allowing a clearance or creepage for an electrical path to extend from said high voltage electrical terminals along said separator wall of said male housing and towards a rear portion of said female housing and across said intermediate upper portion of said female housing and into adjacent high voltage electrical terminals, wherein only, said front downward extending members of said TPA device are accommodated within cavities inside said female housing containing said high voltage electrical terminals when said TPA device is in a full-lock position.

15. The method for improving clearance and creepage in said high voltage connector assembly using said female TPA device in said female and male housings of said high voltage connector assembly according to claim 14, wherein said step of allowing said clearance or creepage for said electrical path includes a step of extending said electrical path substantially vertically from said high voltage electrical terminals through respective apertures passing through said intermediate upper portion of said female housing through which said front downward extending members of said frontward extending members of said female TPA device are accommodated therein when said female TPA device is in a full-lock position.

16. The method for improving clearance and creepage in said high voltage connector assembly using said female TPA device in said female and male housings of said high voltage connector assembly according to claim 14, wherein said step of respectively, inserting said front downward extending members of said frontward extending members of said female TPA device into said apertures of said intermediate upper portion of said female housing includes a step of locking said female TPA device in said female housing at a full-lock position.

* * * * *